United States Patent [19]

Juvrud

[11] 4,070,866

[45] Jan. 31, 1978

[54] TUNNEL LINERS AND METHODS OF MAKING THE SAME

[75] Inventor: Ingvald O. Juvrud, Poland, Ohio

[73] Assignee: Commercial Shearing, Inc., Youngstown, Ohio

[21] Appl. No.: 620,802

[22] Filed: Oct. 8, 1975

[51] Int. Cl.[2] ..... E21D 5/08

[52] U.S. Cl. ..... 61/45 R; 52/245; 61/41 R; 138/155; 138/DIG. 11

[58] Field of Search ..... 61/45 R, 42, 41 R, 84; 52/245, 246, 247, 82, 80, 86; 285/421; 138/100, 101, 102, 165, 156, 157, 155, DIG. 11

[56] References Cited

U.S. PATENT DOCUMENTS

| | | | |
|---|---|---|---|
| 1,304,521 | 5/1919 | Baker | 52/247 |
| 1,923,006 | 8/1933 | Proctor | 61/45 R |
| 2,366,961 | 1/1945 | Fine et al. | 61/45 R |
| 3,429,588 | 2/1969 | Nelson | 285/184 X |
| 3,677,015 | 7/1972 | Chlumecky | 61/45 R |
| 3,737,179 | 6/1973 | White | 285/184 X |
| 3,820,292 | 6/1974 | Fitzpatrick | 52/82 X |

FOREIGN PATENT DOCUMENTS

| | | | |
|---|---|---|---|
| 354,529 | 8/1931 | United Kingdom | 61/45 R |

*Primary Examiner*—Dennis L. Taylor
*Attorney, Agent, or Firm*—Buell, Blenko & Ziesenheim

[57] ABSTRACT

A tunnel liner and segment are provided for simplifying changes in direction. The segment comprises a pair of liner plates each having a curved elongated skin with spaced parallel dependent sidewalls bent at an angle thereto, said liner plates being in spaced side-by-side relationship, spaced apart a selected greater distance at one end than at the other end, a pair of wedge shaped gusset plates in spaced parallel planes fixed to the sidewalls between said liner plates adjacent the top and bottom respectively of the adjacent sidewalls and an end plate at each end of said pairs of liner plates extending the remote sidewalls of each segment and connected to the sidewalls, gusset plates and skins to form a unitary whole.

4 Claims, 6 Drawing Figures

TUNNEL LINERS AND METHODS OF MAKING THE SAME

This invention relates to tunnel liners and methods of making tunnel liners and particularly to tapered tunnel liner sigments for changing direction in sub-surface tunnels.

The excavation and lining of tunnels for waterways, sewers, vehicular traffic including subways is very old. Originally such structures were lined solely with stone or brick masonry, however, the cost of such structures, the dangers involved with their installation and many other factors led to the development of metal tunnel liners which are installed as digging progresses and backed up by grout pumped into the area between the excavation and the metal liner. A final interior finish such as brick, tile or the like is inserted within the metal liner as a facing. Typical of the metal liners which have been utilized in tunnel linings are those disclosed in U.S. Pat. Nos. 3,483,706 and 3,396,543. These liners are all assembled from segments which are bolted together in the tunnel cavity immediately behind the tailskin of the shield around the drilling equipment. Considerable difficulty has been experienced in the past in changing the direction of the tunnel liner to follow a curve or other change of direction in the tunnel bore. Since all tunnel liner segments are identical they form an identical circular ring section when assembled and when adjacent circular or ring segments are put together they form a straight cylinder. It is not possible simply to space edges of adjacent segments apart to form a curve because it is essential that the liner be substantially water tight. As a result it has been the practice to take tunnel liner segments such as are disclosed in the aforementioned patents and on the job to cut out tapered segments from the top skin, force the cut edges together and weld them to form a smaller tapered plate which could be used on the inside of the curve or direction change. This practice is of course costly, difficult nd wasteful of time and material.

I have invented a tunnel liner segment which materially simplifies the change of direction in tunnel lining construction, reduces the cost and eliminates the problems of leakage and distortion which occurred in past practices.

I provide a liner segment made up of a pair of liner plates each comprising a curved elongated skin plate having spaced parallel sidewalls bent at an angle thereto, said liner plates being in side-by-side relationship spaced apart a selected greater amount at one end than at the other end, a pair of wedge shaped gusset plates in spaced parallel planes fixed to the sidewalls between said liner plates adjacent the top and bottom respectively of the adjacent sidewalls and an end plate at each end of said pairs of liner plates extending between the two remote sidewalls of each segment and connected to the sidewalls, gusset plates and skins to form a unitary whole. Preferably the inner wedge shaped gusset plate is slightly smaller than the outer.

In the foregoing general description I have set out certain objects, purposes and advantages of my invention. Other objects, purposes and advantages of this invention will be apparent from a consideration of the following description and the accompanying drawings in which.

Figure 1:
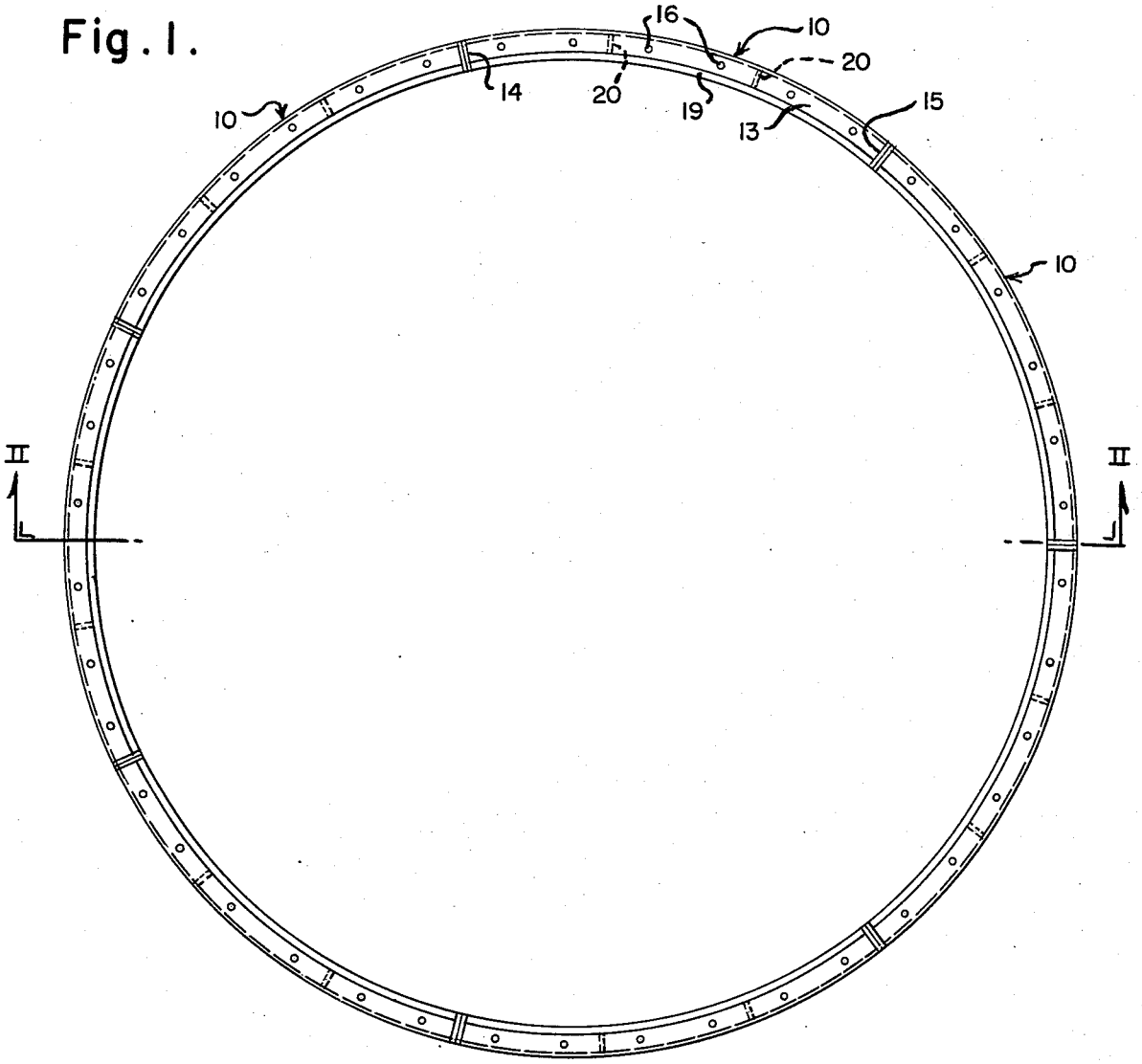
FIG. 1 is a vertical cross section through a tunnel liner embodying this invention.
Figure 2:
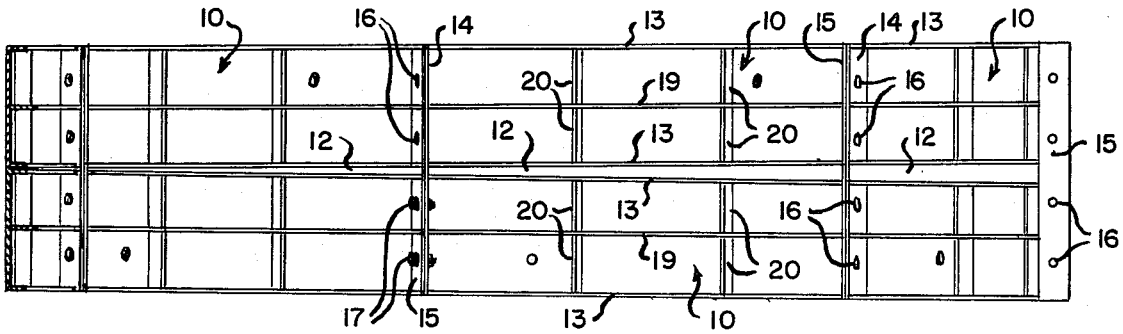
FIG. 2 is a section on the line II—II of FIG. 1.
Figure 3:
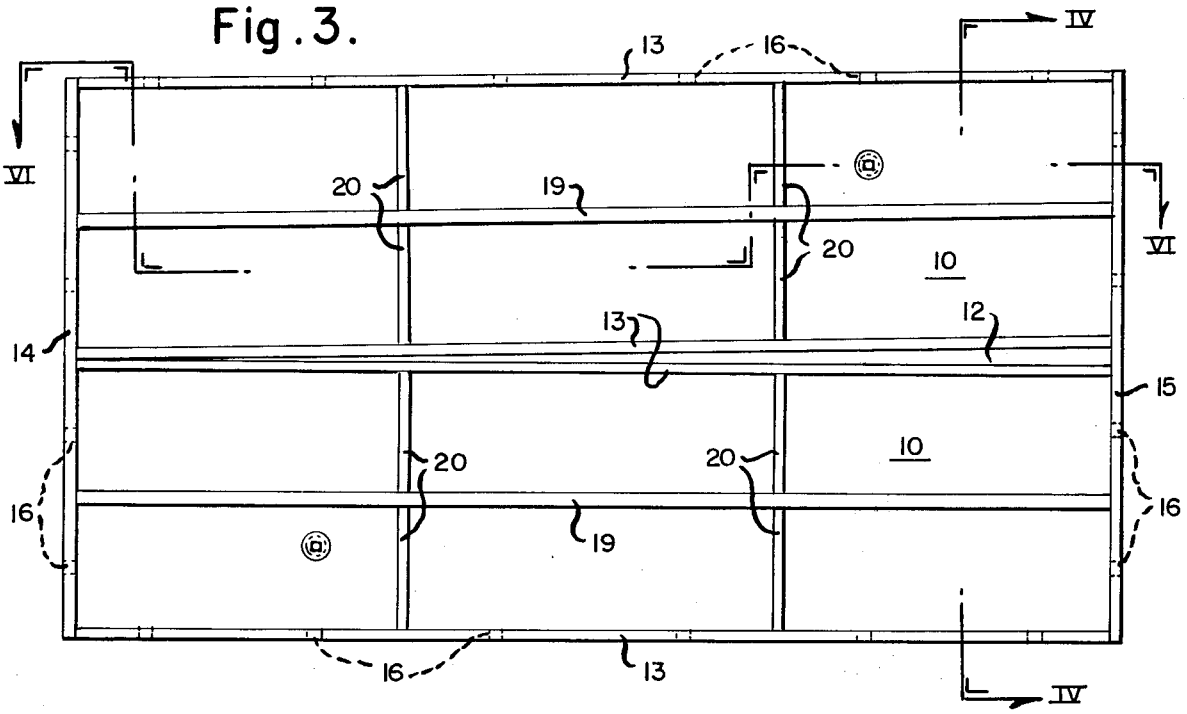
FIG. 3 is an enlarged plan view of one liner plate of FIG. 2 according to this invention.
Figure 4:
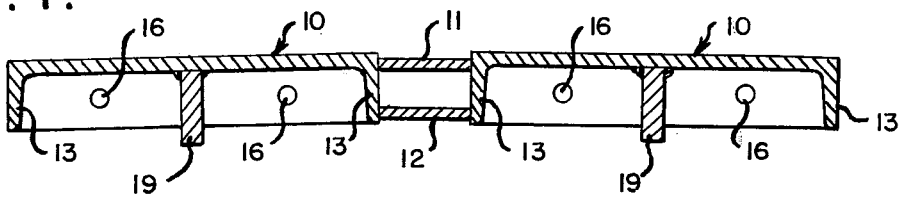
FIG. 4 is a section on the line IV—IV of FIG. 3.
Figure 5:
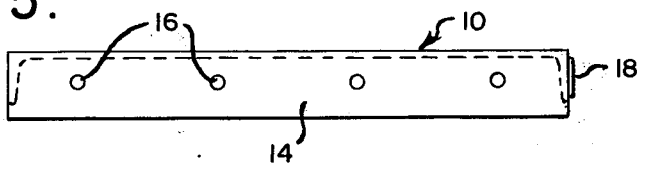
FIG. 5 is an end elevation of the liner plate of FIG. 3.
Figure 6:
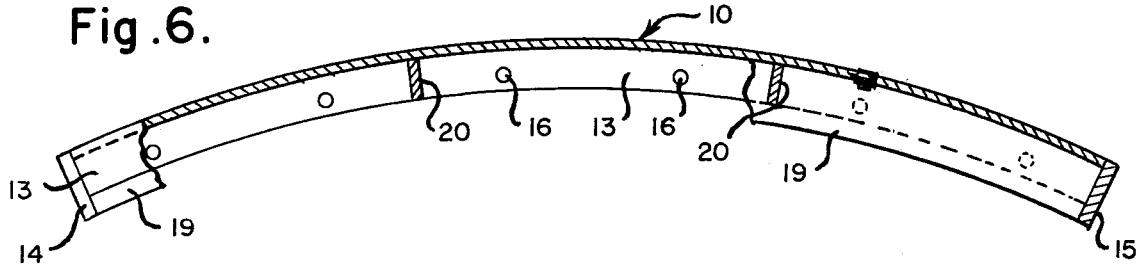
FIG. 6 is a section partly in elevation of the liner plate taken on the line VI—VI of FIG. 3.

Referring to the drawings, I have illustrated liner segments according to this invention design to change the direction of the tunnel lining. The plates of this invention are made up of two standard liner plates 10, as used in the assembly of the straight tunnel segments, in side-by-side relation with a pair of wedge shaped gusset plates at top 11 and bottom 12 welded to adjacent side flanges 13 of the liner plates. The bottom gusset plate is slightly less in width than the top gusset plate, particularly in the segments having largest plates. As is shown in FIG. 2, the gusset plates 11 and 12 are graduated in size as the segments progress around the circle forming the tunnel segment. Each liner plate assembly has end plates 14 and 15 welded to the liner plates and gusset plates to form a unitary assembly. Each end plate 14 and 15 and each side flange 13 is provided with holes 16 receiving bolts 17 which bring the plates into sealing arrangement with gaskets 18 which are fixed to two adjacent ends on flanges so as to make the joints waterproof. Each liner plate is provided with a longitudinally extending center rib 19 running from end plate to end plate and welded thereto, and with transverse ribs 20 extending from side flange to side flange.

The liner plates of this invention are assembled as shown in FIG. 2 with the point of the wedge shaped gusset plates starting at the inner portion of the change of direction and enlarging to the widest portion and then reversing to form a completed circular tunnel segment. Plates of this invention are continued to be assembled as in FIG. 2 until the desired change of direction has been accomplished.

In the foregoing specification I have illustrated and described certain presently preferred practices and embodiments of my invention, however, it will be understood that this invention may be otherwise embodied within the scope of the following claims.

I claim:

1. A tunnel liner annulus for changing direction of the liner comprising a plurality of end to end liner segments bolted together at the ends, sealing means between adjoining ends, said liner segments each comprising a pair of liner plates each having a curved elongated skin forming an arc of said annulus, each skin having spaced dependent sidewalls bent at an angle thereto, each successive pair of liner plates in the annulus being in spaced apart side-by-side relationship, spaced apart a greater distance at one end than at the other end, a pair of wedge shaped gusset plates in spaced parallel planes fixed to the sidewalls betwen said liner plates adjacent the top and bottom respectively of the adjacent sidewalls and an end plate at each end of said pairs of liner plates extending the remote sidewalls of each segment and connected to the sidewalls, gusset plates and skins to form a unitary whole, and said segments being arranged so that the wedge shaped gusset plates are in ascending order to a selected maximum and then in descending order to a minimum.

2. A tunnel liner annulus as claimed in claim 1 wherein the sealing means is a neoprene gasket.

3. A tunnel liner annulus as claimed in claim 1 wherein the sidewalls between the liner plates have holes for receiving fasteners and fasteners are provided in each hole to assemble the annulus.

4. A tunnel liner annulus as claimed in claim 3 wherein the fasteners are bolts.

* * * * *